US007069915B2

(12) United States Patent
Brandenburg et al.

(10) Patent No.: US 7,069,915 B2
(45) **Date of Patent: *Jul. 4, 2006**

(54) PRESSURE ACTUATED FUEL VENT CLOSURE AND FUEL SHUTOFF APPARATUS

(75) Inventors: Billy J. Brandenburg, Horicon, WI (US); Peter J. Nushart, Waukesha, WI (US); Gary J. Gracyalny, Milwaukee, WI (US); John H. Thiermann, Greenfield, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 381 days.

This patent is subject to a terminal disclaimer.

(21) Appl. No.: 10/246,329

(22) Filed: Sep. 18, 2002

(65) Prior Publication Data

US 2003/0111062 A1 Jun. 19, 2003

Related U.S. Application Data

(63) Continuation-in-part of application No. 10/021,989, filed on Dec. 13, 2001, now Pat. No. 6,986,340, and a continuation-in-part of application No. 10/023,244, filed on Dec. 13, 2001, now Pat. No. 6,691,683.

(51) Int. Cl.
*F02M 37/04* (2006.01)

(52) U.S. Cl. ..... 123/516; 123/198 DB

(58) Field of Classification Search ..... 123/382, 123/383, 516, 198 DB, 519, 520, 521
See application file for complete search history.

(56) References Cited

U.S. PATENT DOCUMENTS 1,473,303 A 11/1923 Lightford
2,131,811 A 10/1938 Kittredge
2,358,840 A 9/1944 Walker
2,706,025 A 4/1955 Halttunen
3,391,679 A 7/1968 Williams et al.
3,601,107 A 8/1971 Rohrbacher et al.
3,610,220 A 10/1971 Yamada et al.
3,610,221 A 10/1971 Stoltman
3,617,034 A 11/1971 Skinner
3,645,244 A 2/1972 Seyfarth
3,650,256 A 3/1972 Marshall
3,653,537 A 4/1972 Shiobara et al.
3,678,912 A 7/1972 Hensler
3,696,799 A 10/1972 Gauck
3,703,165 A 11/1972 Hansen
3,731,663 A 5/1973 Hollins
3,750,636 A * 8/1973 Okura ..... 123/382
3,779,224 A 12/1973 Tagawa et al.
3,844,264 A 10/1974 Grainger
3,897,771 A 8/1975 Stumpp (Continued)

*Primary Examiner*—Carl S. Miller
(74) *Attorney, Agent, or Firm*—Michael Best & Friedrich,LLP

(57) ABSTRACT

A device includes an internal combustion engine, an engine control device coupled to the internal combustion engine and manually operable to stop operation of the engine, a fuel tank coupled to the engine for providing fuel to the engine, and a fuel vent closure device communicating with the fuel tank. The fuel vent closure device is automatically operable in response pressure changes in the engine to substantially seal the fuel tank when the engine is stopped, thereby substantially preventing emissions from the fuel tank. The device also preferably includes a fuel shutoff device automatically operable in response to pressure changes in the engine to substantially block the supply of fuel to the engine when the engine is stopped.

40 Claims, 15 Drawing Sheets

U.S. PATENT DOCUMENTS 4,050,436 A 9/1977 Crabtree
4,077,381 A 3/1978 Firey
4,078,536 A 3/1978 Ozawa et al.
4,111,175 A 9/1978 Nakamura et al.
4,111,176 A 9/1978 Fenton et al.
4,154,204 A * 5/1979 Bonin ..... 123/382
4,161,639 A 7/1979 Nofel
4,178,894 A 12/1979 Nau
4,198,816 A 4/1980 Hasegawa et al.
4,285,440 A 8/1981 Adams
4,368,618 A 1/1983 Nave
4,414,162 A 11/1983 Ii et al.
4,416,108 A 11/1983 Ghandhi
4,421,089 A 12/1983 Moore, Jr.
4,454,783 A * 6/1984 Sierk et al. ..... 74/471 R
4,510,739 A 4/1985 Dluhosch
4,577,597 A 3/1986 Tomita
4,633,843 A 1/1987 Wissmann et al.
4,694,810 A 9/1987 Miyamoto
4,924,827 A 5/1990 Minegishi
4,981,120 A 1/1991 Mangum, Jr.
5,003,948 A 4/1991 Churchill et al.
5,050,548 A 9/1991 Minegishi
5,092,295 A 3/1992 Kobayashi
5,203,306 A 4/1993 Billingsley et al.
5,211,151 A * 5/1993 Nakajima et al. ..... 123/520
5,301,644 A 4/1994 Olmr
5,357,935 A 10/1994 Oxley et al.
5,445,121 A 8/1995 Kai
5,676,115 A * 10/1997 Linsbauer et al. ..... 123/516
5,797,374 A 8/1998 Minagawa et al.
6,082,323 A 7/2000 Winberg
6,213,083 B1 4/2001 Winberg
6,691,683 B1 * 2/2004 Gracyalny et al. ..... 123/516
6,986,340 B1 * 1/2006 Gracyalny et al. ..... 123/516

* cited by examiner

PRESSURE ACTUATED FUEL VENT CLOSURE AND FUEL SHUTOFF APPARATUS

RELATED APPLICATIONS

This application is a continuation-in-part of U.S. patent application Ser. No. 10/021,989, filed Dec. 13, 2001, now U.S. Pat. No. 6,986,340, and of U.S. patent application Ser. No. 10/023,244, filed Dec. 13, 2001 now U.S. Pat. No. 6,691,683.

FIELD OF THE INVENTION

The present invention relates to the field of internal combustion engines and, more particularly, to the control of evaporative emissions and fuel tank venting.

BACKGROUND OF THE INVENTION

Internal combustion engines are used in a variety of applications, such as lawnmowers, generators, pumps, snow blowers, and the like. Such engines usually have fuel tanks coupled thereto to supply fuel to the engine through a supply line. It is desirable to reduce emissions from devices powered by internal combustion engines. Even when the engine is not being used, the engine can release emissions of hydrocarbons or gasoline resulting from daily ambient temperature changes. Such emissions are known as "diurnal" emissions.

To help reduce emissions from the engine, it is known to provide internal combustion engines with fuel shutoff devices that block the flow of fuel to the engine upon engine ignition shutdown. Without such a shutoff device, fuel is wasted, and unburned fuel is released into the environment, thereby increasing hydrocarbon exhaust emissions. Likewise, the presence of unburned fuel in the combustion chamber may cause dieseling. When the engine is not operating, pressure buildup in the fuel tank caused by increased ambient temperatures can force fuel into the engine, where the fuel can be released into the atmosphere.

It is also desirable to reduce emissions from the fuel tank. Fuel tanks are typically vented to the atmosphere to prevent pressure buildup in the tank. While the engine is operating and drawing fuel from the fuel tank, the vent in the fuel tank prevents excessive negative pressure inside the tank. While the engine is not operating (i.e., in times of non-use and storage), the vent prevents excessive positive pressure that can be caused by fuel and fuel vapor expansion inside the tank due to increased ambient temperatures. Fuel vapors are released to the atmosphere, primarily when a slight positive pressure exists in the tank.

One common method of venting fuel tanks includes designing a permanent vent into the fuel tank cap. Typically, the fuel tank is vented via the threads of the screw-on fuel tank cap. Even when the cap is screwed tightly on the tank, the threaded engagement does not provide an airtight seal. Therefore, the fuel tank is permanently vented to the atmosphere. Another method of venting fuel tanks includes the use of a vent conduit that extends away from the tank to vent vapors to a portion of the engine (i.e., the intake manifold) or to the atmosphere at a location remote from the tank.

SUMMARY OF THE INVENTION

The present invention provides a device that includes an internal combustion engine, a fuel tank that provides fuel to the engine, and a fuel vent closure device that is automatically operable in response to pressure changes in the engine to substantially seal the fuel tank when the engine is stopped. In some embodiments, the fuel vent closure device includes a valve that is actuated by a piston device housed in a pressure cylinder. The piston device is movable within the pressure cylinder in response to the engine pressure changes to operate the valve. The fuel vent closure device can also operate in response to pressure changes in the engine to vent the fuel tank while the engine is running.

The piston device can be reciprocable within the pressure cylinder, or the piston can be rotatable within the pressure cylinder, depending upon the application. Preferably, the piston device delimits the pressure cylinder into two fluidly isolated chambers. Each chamber can be coupled to one of an intake manifold and an exhaust manifold of the engine. Pressure changes in the intake and exhaust manifolds move the piston device within the pressure cylinder to open and close the valve. The fuel vent closure device can also be coupled to an auxiliary pressure supply device that operates in response to rotation of the engine.

In various embodiments, the device can be a lawnmower, a pressure washer, a portable generator, an automatic backup power system, a tractor, or a riding lawnmower. Also, the internal combustion engine can be a multi-cylinder engine or a single-cylinder engine. The device can also include a fuel shutoff device that is automatically operable in response to pressure changes in the engine to substantially block a supply of fuel to the engine when the engine is stopped. The fuel shutoff device can also be a valve and may be combined with the fuel vent closure to form a single assembly. As such, the fuel vent closure device can be automatically operable in response to pressure changes in the engine to vent the fuel tank when the engine is started, and the fuel shutoff device can be automatically operable in response to similar pressure changes in the engine to unblock the supply of fuel to the engine when the engine is started.

In some embodiments, the fuel vent closure device and the fuel shutoff device are automatically operable in response to pressure changes in the intake manifold and the exhaust manifold of the engine. Alternatively, the fuel vent closure device and the fuel shutoff can be automatically operable in response to pressure changes in an auxiliary pressure supply device of the engine.

Other features and advantages of the invention will become apparent to those skilled in the art upon review of the following detailed description and drawings.

Figure 1:
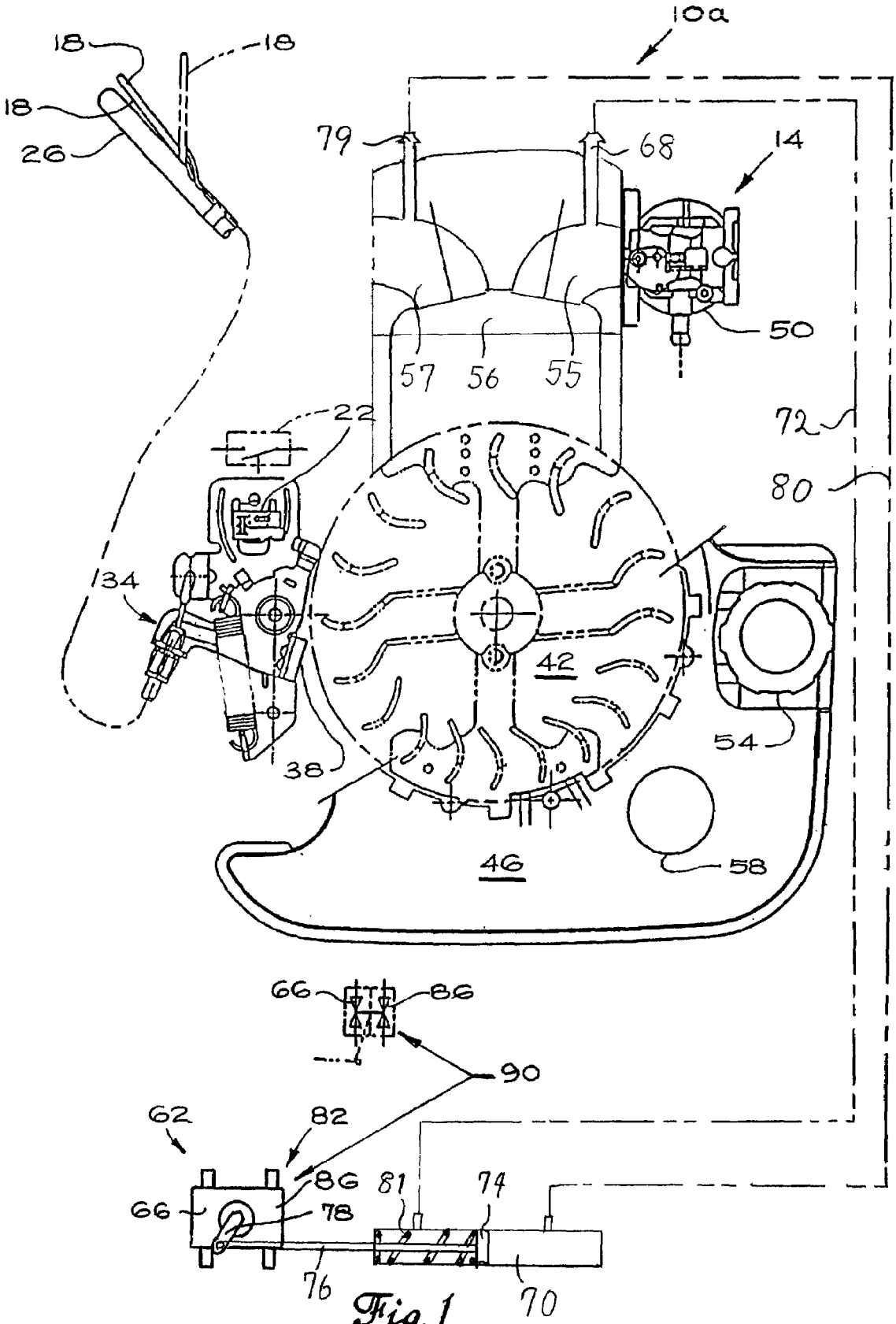
FIG. 1 is a schematic view of an internal-combustion-engine-powered device having a fuel vent closure and fuel shutoff device embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

Figure 24:
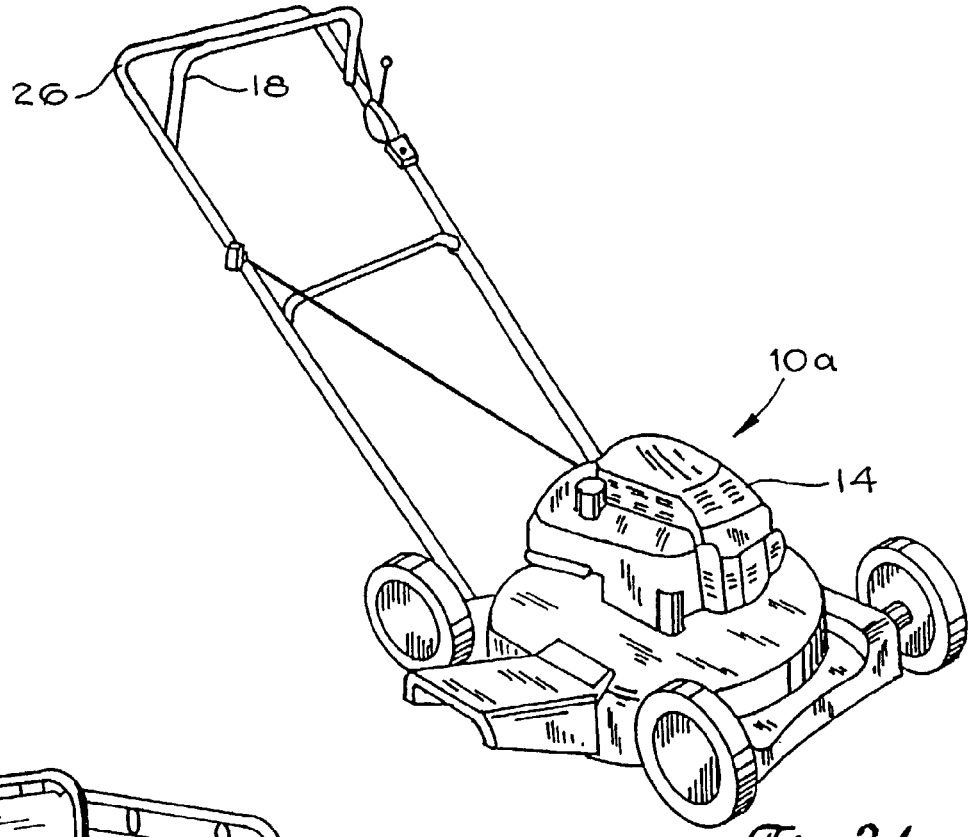
FIG. 24 is a lawnmower having an internal combustion engine embodying the invention.
Figure 25:
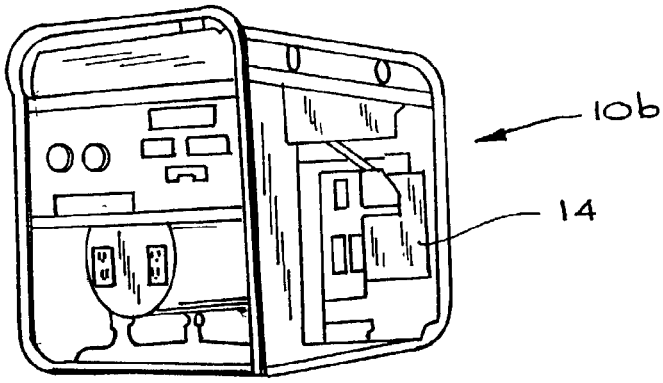
FIG. 25 is a portable generator having an internal combustion engine embodying the invention.
Figure 26:
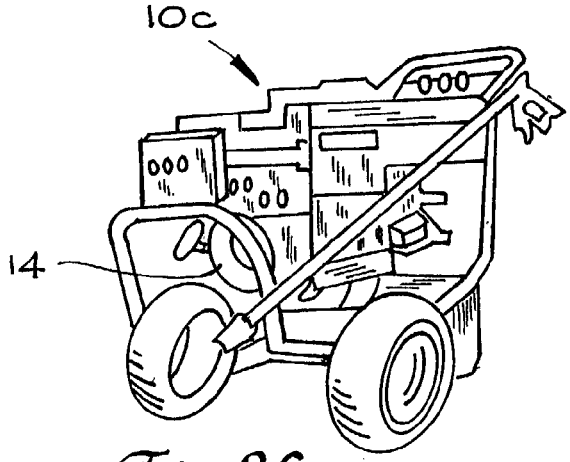
FIG. 26 is a portable pressure washer having an internal combustion engine embodying the invention.
Figure 27:
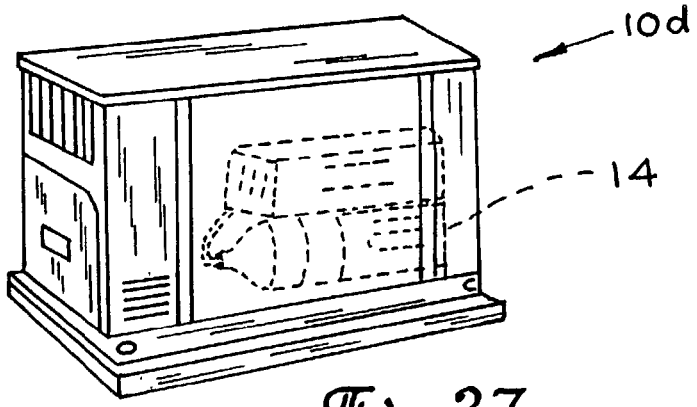
FIG. 27 is an automatic backup power system having an internal combustion engine embodying the invention.
Figure 28:
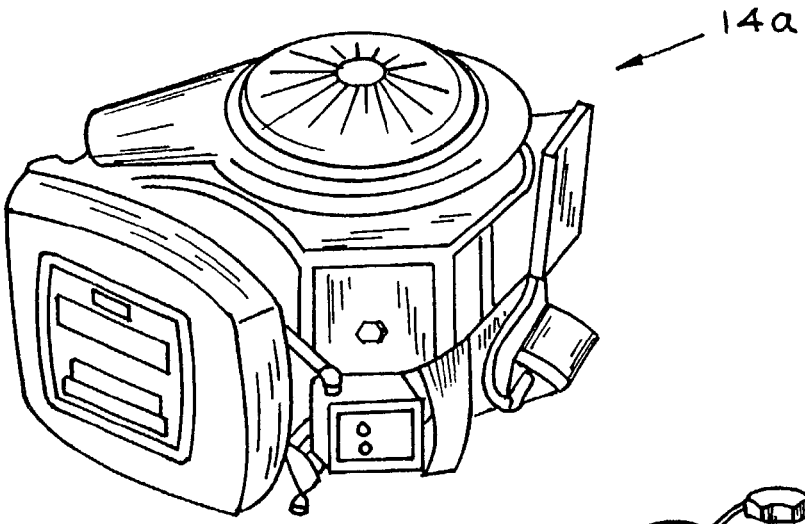
FIG. 28 is a multi-cylinder, V-twin internal combustion engine embodying the invention.
Figure 29:
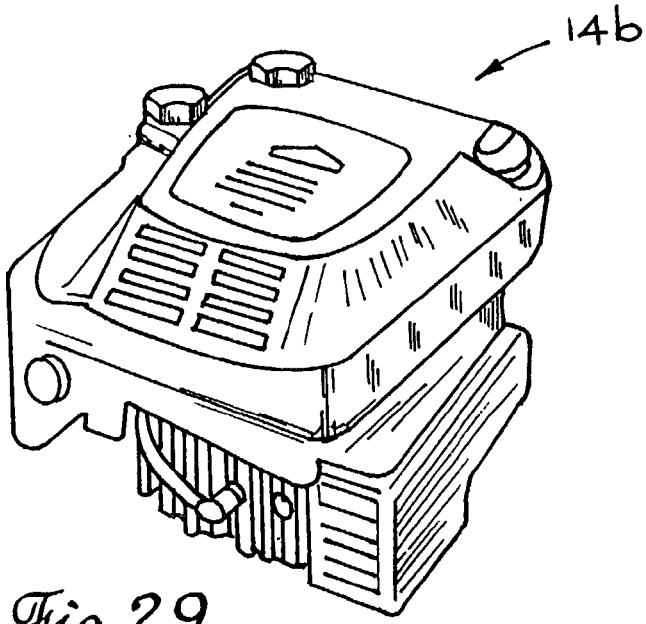
FIG. 29 is a single cylinder internal combustion engine embodying the invention.
Figure 30:
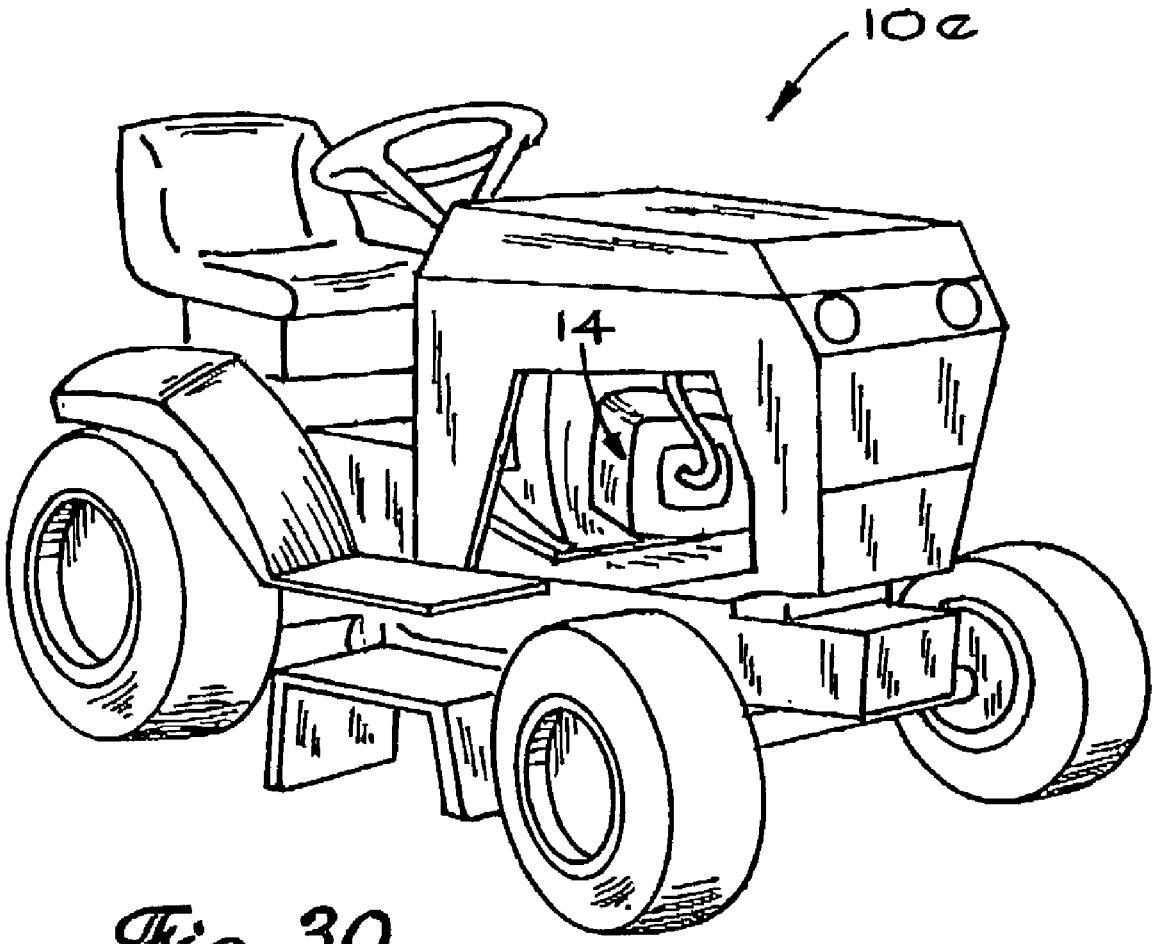
FIG. 30 is a tractor or riding lawnmower having an internal combustion engine embodying the invention.

FIG. 1 schematically illustrates a device 10 having an internal combustion engine 14. In FIG. 1, the device 10 is illustrated as being a lawnmower 10*a* (see FIG. 24), but could alternatively be a snow blower (not shown), a portable generator 10*b* (see FIG. 25), a pump, such as the type commonly used in a portable pressure washer 10*c* (see FIG. 26), a stand-alone generator, such as the type commonly used for an automatic backup power system 10*d* (see FIG. 27), a riding lawnmower or tractor 10*e* (see FIG. 30), or the like. The engine 14 can be a multi-cylinder engine, such as a V-twin or opposed-cylinder engine 14*a* (see FIG. 28), or a single-cylinder engine 14*b* (see FIG. 29).

The lawnmower 10*a* includes an engine control device 18 coupled to the internal combustion engine 14. The engine control device 18 is manually operable to stop operation of the engine 14 by grounding an ignition switch 22. The engine control device 18 shown in FIG. 1 is known as a deadman lever or a bail lever and is mounted on the lawnmower handle 26, remote from the engine 14, as is commonly understood. A bowden cable or other suitable actuator 30 (shown schematically) connects the engine control device 18 to a linkage assembly 34 that actuates the ignition switch 22. Any suitable linkage assembly 34 can be used.

The engine control device 18 can also operate to stop the rotation of the blade (not shown). As seen in FIG. 1, an engine flywheel brake 38 is mounted on the linkage assembly 34. When the deadman lever is released (as shown in phantom in FIG. 1), the linkage assembly 34 is oriented such that the brake 38 engages a flywheel 42. Stopping the rotation of the flywheel 42 stops the rotation of the blade. Other blade braking mechanisms are also known and can be used instead of the engine flywheel brake 38.

The lawnmower 10*a* also includes a fuel tank 46 coupled to the engine 14 for providing fuel to the engine 14. More specifically, the fuel tank 46 supplies fuel to a carburetor 50 as is commonly understood. Of course, the engine 14 could also be a non-carbureted engine, in which case, fuel would be supplied to a fuel injection system. The fuel tank 46 is filled by removing a fill cap 54. Unlike prior art threaded fill caps, the fill cap 54 provides an airtight seal when closing the fuel tank 46. The fill cap 54 can be configured in any suitable manner to close and seal the tank 46.

The carburetor 50 is coupled to an engine intake manifold 55 which delivers a fuel mixture prepared by the carburetor 50 to a combustion chamber 56. During engine operation, a vacuum is created in the intake manifold 55 that draws the fuel mixture from the carburetor 50, through the intake manifold 55, and into the combustion chamber 56. After the fuel mixture is combusted in the combustion chamber 56, thereby creating exhaust gasses, the exhaust gasses are expelled from the combustion chamber 56 through an exhaust manifold 57. The expulsion of exhaust gasses into the exhaust manifold 57 increases the pressure in the exhaust manifold 57 during engine operation. The flow of the fuel mixture and the exhaust gasses into and out of the combustion chamber 56 can be controlled by intake and exhaust valves (shown schematically) as is known in the art.

The fuel tank 46 also includes a vent 58 (shown schematically in FIG. 1) that can be selectively opened and closed as will be described below. Any suitable vent configuration that permits selective opening and closing can be used. Some examples of vent configurations are shown in FIGS. 3–10. The vent 58 provides selective communication between the inside of the tank 46 and the atmosphere. When the vent 58 is open, the fuel tank 46 communicates with the atmosphere only via the vent 58. When the vent 58 is closed, the fuel tank 46 does not communicate with the atmosphere. Therefore, closing the vent 58 reduces diurnal emissions from the tank 46. The fuel tank 46 may be designed to accommodate pressure fluctuations caused by the expansion of fuel in the tank 46 when the vent 58 is closed.

The lawnmower 10*a* further includes a fuel vent closure device 62 that selectively opens and closes the vent 58. The fuel vent closure device 62 preferably includes a valve 66 (also shown schematically in FIG. 1) communicating between the vent 58 and a fuel vapor disbursal system, such as the air intake to the carburetor 50. The valve 66 can be of any suitable design. Several possible designs are shown in FIGS. 10–23, which will be discussed below. Opening the valve 66 opens the vent 58, thereby providing communication between the inside of the tank 46 and the atmosphere. Closing the valve 66 closes the vent 58, thereby preventing communication between the inside of the tank 46 and the atmosphere.

To reduce diurnal emissions from the fuel tank 46, the valve 66 should be closed when the engine 14 stops running, and should remain closed until the engine 14 is ready to be run or is running. To accomplish this, the vent closure device 62 is actuated automatically in response pressure changes within the engine that occur when the engine is started and stopped. Specifically, when the operator starts the engine 14, the vent closure device 62 automatically opens the valve 66 in response to pressure changes within the engine, such as pressure changes in the intake or exhaust manifolds 55, 57, thereby opening the vent 58. When the operator stops the engine 14, the vent closure device 62 closes the valve 66 in response to further pressure changes within the engine, thereby closing the vent 58. By incorporating the operation of the vent closure device 62 with the pressure changes inherent in engine operation, no additional action to open or close the vent 58 is required on behalf of the operator.

As seen in FIG. 1, the vent closure device 62 operates in response to at least one of the vacuum generated in the engine intake manifold 55 and the increase in pressure generated in the engine exhaust manifold 57 during engine operation. More specifically, the vent closure device 62 is in fluid communication with at least one of the intake manifold 55 and the exhaust manifold 57 such that the vacuum and/or the pressure increase that occurs during engine operation is communicated to the vent closure device 62, which in turn actuates the valve 66. An intake pressure tap 68 communicates with the intake manifold 55 and fluidly communicates with a pressure cylinder 70 by way of a first fluid conduit 72. The pressure cylinder 70 is delimited into two chambers by a piston device 74 including an arm portion 76 that is coupled to a valve actuating member 78. Similarly, an exhaust pressure tap 79 communicates with the exhaust manifold 57 and fluidly communicates with the pressure cylinder 70 by way of a second fluid conduit 80. The second fluid conduit 80 communicates with the pressure cylinder 70 on an opposite side of the piston device 74 as the first fluid conduit 72. In this way, during engine operation, the reduction in pressure in the intake manifold 55 is communicated to one side of the piston device 74, and the increase in pressure in the exhaust manifold 57 is communicated to the other side of the piston device 74. The pressure differences on each side of the piston device 74 urge the piston device 74 in a valve opening direction (e.g. to the left as illustrated in FIG. 1). Movement of the piston device 74 actuates the valve-actuating member 78 to open and close the valve 66. Preferably, the piston device 74 and/or the valve actuating member 78 are biased in a valve closing direction by a spring 81 or other suitable biasing member.

It is not necessary for the vent closure device 62 to automatically open the vent when the engine 14 is operating. Rather, the vent closure device 62 could operate automatically to close the vent 58 in response to shut down of the engine, but could require additional action on behalf of the operator to manually open the vent 58 in order to run the engine 14.

The lawnmower 10*a* also preferably includes a fuel shutoff device 82 that selectively blocks the fuel supply to the carburetor 50. The fuel shutoff device 82 includes a valve 86 communicating between the fuel tank 46 and the carburetor 50. The valve 86 can be of any suitable design. Several possible designs are shown in FIGS. 10–23, which will be discussed below. Opening the valve 86 provides fluid communication between the inside of the tank 46 and the carburetor 50. Closing the valve 86 blocks fluid communication between the inside of the tank 46 and the carburetor 50.

As shown in FIG. 1, the valve 86 for the fuel shutoff device 82 is actuated concurrently with actuation of the valve 66 for the vent closure device 62. The same pressure cylinder 70 and piston device 74 discussed above with respect to the vent closure device 62 also actuates the fuel shutoff device 82. The specific method of actuation can vary, and several different possibilities are discussed below. Therefore, when the engine 14 stops running, the pressures within the intake manifold 55 and the exhaust manifold 57 equalize, the piston device 74 moves in the valve-closing direction, the fuel vent 58 is closed, and the fuel supply to the carburetor 50 is blocked. When the engine 14 is started, the vacuum forms in the intake manifold 55, the pressure increases in the exhaust manifold 57, the piston is urged in the valve-opening direction, the vent 58 is opened, and the fuel supply to the carburetor 50 is unblocked.

As will be discussed in more detail below, it is possible to incorporate both valves 66 and 86 in a single valve assembly 90, thereby reducing the number of parts on the device. On the other hand, the fuel shutoff device 82 need not be actuated concurrently with, or via the same pressure cylinder 70 and piston device 74 as the vent closure device 62, and could be completely separate from the vent closure device 62.

Figure 2:
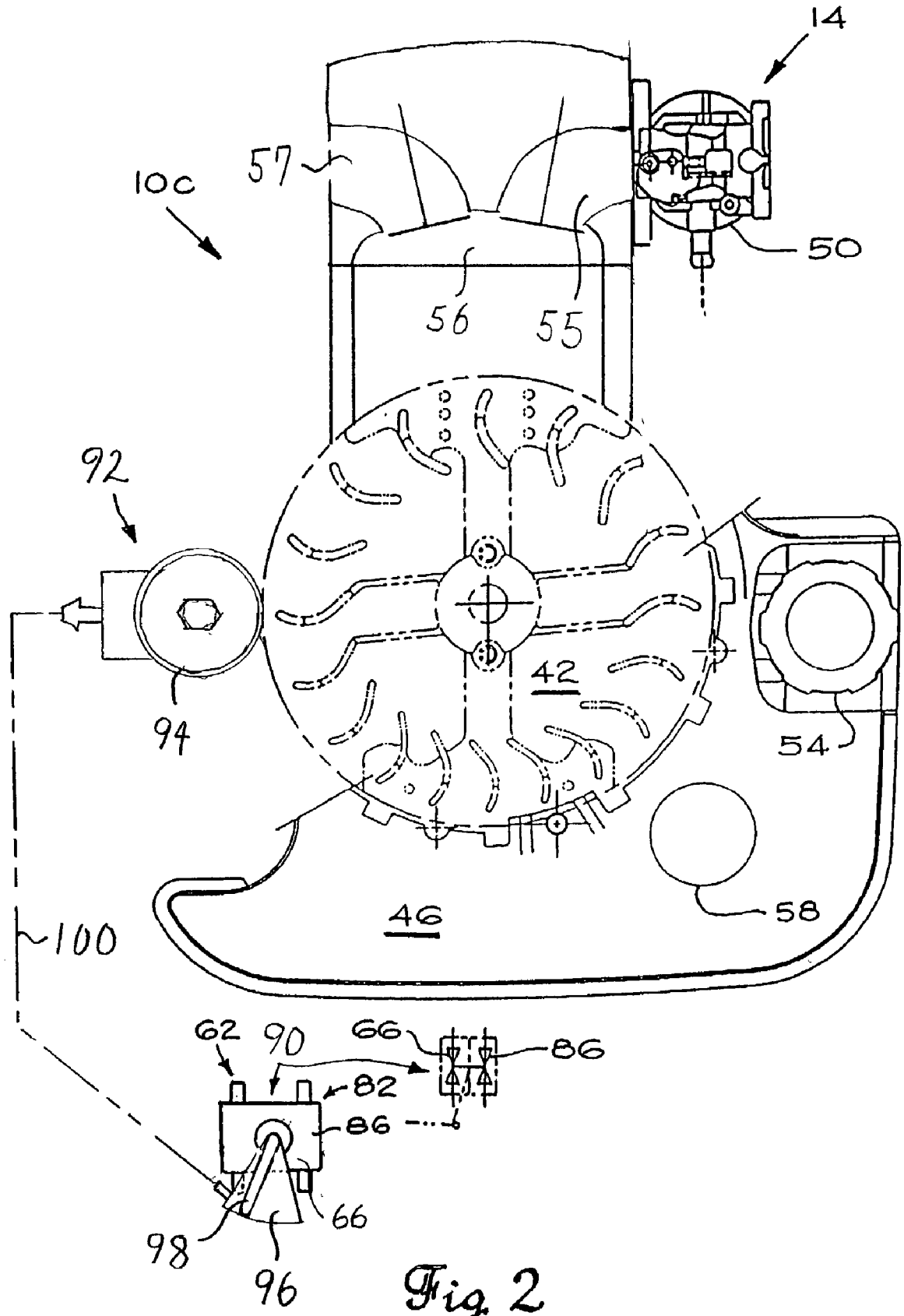
FIG. 2 is a schematic view of an internal-combustion-engine-powered device having an auxiliary pressure supply device coupled to the fuel vent closure and fuel shutoff device embodying the invention.

FIG. 2 schematically illustrates a device 10*c* that operates slightly different than the device 10*a*. The device 10*c* is illustrated as being a pump or a pressure washer (see FIG. 26), but could alternatively be a lawnmower 10*a* (see FIG. 24), a generator 10*b* and 10*d* (see FIGS. 25 and 27), a compressor, snow blower, tiller, string trimmer, or the like. The operation of the device 10*c* is substantially similar to the operation of the lawnmower 10*a*, with some exceptions which will be discussed below. Like parts have been given like reference numerals.

The device 10*c* includes an auxiliary pressure supply device 92 in the form of an air pump. The auxiliary pressure supply device 92 includes a drive wheel 94 that is drivingly rotated by the engine flywheel 42 during engine operation. Of course the auxiliary pressure supply device 92 can be driven by substantially any rotating component of the engine 14. Rotation of the drive wheel 94 creates an increase or a decrease in pressure within an inner chamber of the auxiliary pressure supply device 92. Like the device 10*a*, a pressure cylinder 96 and a piston device 98 are coupled to the vent closure device 62 and the fuel shutoff device 82. The pressure cylinder 96 and piston device 98 of FIG. 2 are of the rotating type, as opposed to the reciprocating type illustrated in FIG. 1. As illustrated, the rotating piston device 98 can also perform the operations of the valve actuating member 78. The piston device 98 delimits the pressure cylinder 96 into two chambers. One of the chambers fluidly communicates with the auxiliary pressure supply device 92 by way of a fluid conduit 100, the other chamber can be open to the atmosphere, or can be communicated with another pressure supply device if desired. During engine operation, the reduced or elevated pressure that is provided by the auxiliary pressure supply device 92 is communicated to the pressure cylinder 96 and urges the piston device 98 in a valve-opening direction (e.g. in a clockwise direction as illustrated). Preferably, the piston device 98 is biased in a valve-closing direction by a torsion spring (not shown) other suitable biasing member. It should be appreciated that the auxiliary pressure supply device 92 can be configured to provide a reduction or an increase in pressure, and that the fluid conduit 100 can be coupled to either side of the pressure cylinder 96 to provide appropriate actuation of the vent closure device 62 and the fuel shutoff device 82. In addition, the auxiliary pressure supply device 92 can also be used with the reciprocating pressure cylinder 70 and piston device 74 of FIG. 1.

The fuel vent closure device 62 and the fuel shutoff device 82 can be configured operate in response to the elevated and/or reduced pressures provided by the auxiliary pressure supply device 92 in substantially the same manner as described above with respect to the lawnmower 10*a*. Therefore, when the engine 14 stops running, the drive wheel 94 of the auxiliary pressure supply device 92 stops rotating and the pressures in the chambers of the pressure cylinder 96 equalize, thereby rotating the piston device 98 such that the fuel vent 58 is closed, and the fuel supply to the carburetor 50 is blocked. When the engine 14 is started, the drive wheel 94 rotates and the auxiliary pressure supply device 92 operates to elevate or reduce the pressure in one of the chambers of the pressure cylinder 96, thereby rotating the piston device 98 such that the vent 58 is opened, and the fuel supply to the carburetor 50 is unblocked.

In both examples provided above, the pressure cylinders 70, 96 and piston devices 74, 98 are actuated in response to the starting and stopping of the engine, and are coupled to the valve 66 for the vent closure device 62 and to the valve 86 for the fuel shutoff device 82. Because the single valve assembly 90 is actuated in response to operation of the engine 14, the valve assembly 90 can be used with engines that are configured for both manual starting and automatic (e.g. electric) starting. Due to the potential for lag between engine operation and the establishment of pressure differentials that are sufficient to operate the vent closure device 62 and the fuel shutoff device 82, the fuel valve 86 can be provided with a prime button 104 (see FIGS. 13, 14, 17, and 18) for manually supplying an initial quantity of fuel to the engine. Also, the pressure cylinders 70, 96 and piston devices 74, 98 are substantially interchangable, and either combination of pressure cylinder and piston device can be adapted for operation with the auxiliary pressure supply device 92, or with the engine intake and exhaust manifolds 55, 57.

It should be noted that tractors and riding lawnmowers 10*e* often include safety interlock switches, normally located under the seat, that sense the presence of the operator. When the operator leaves the seat while the tractor is in use, the safety interlock switch grounds the ignition to stop the engine. Other safety interlock switches may also be used. According to the invention, these safety interlock switches will also result in closure of the fuel vent and blockage of the fuel supply to the carburetor due to the stoppage of the engine when the safety interlock switch is tripped.

Figure 3:
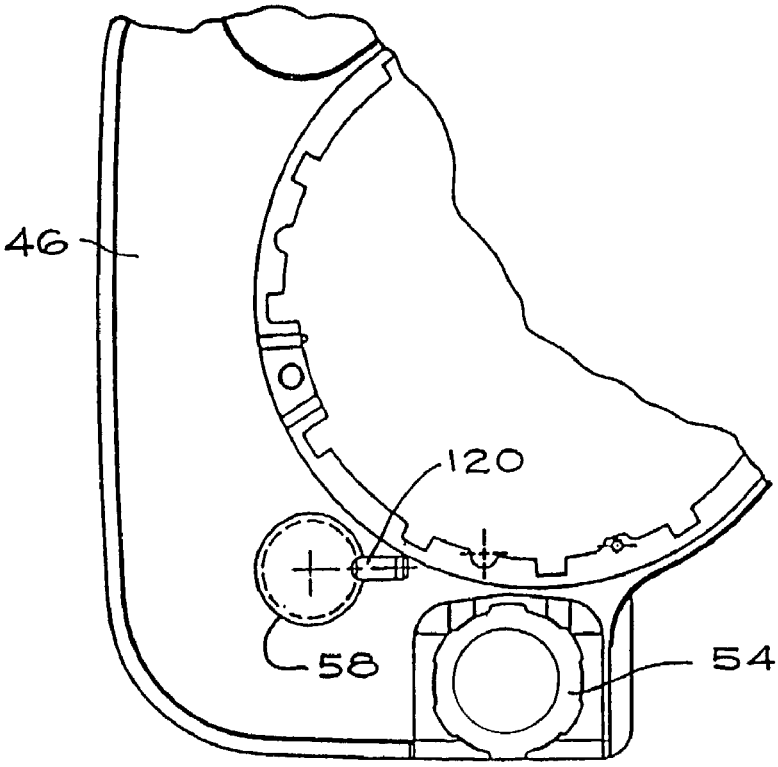
FIGS. 3 and 4 show a fuel tank having a vent and a fuel supply port adapted to be connected to the fuel vent closure and fuel shutoff device.
Figure 4:
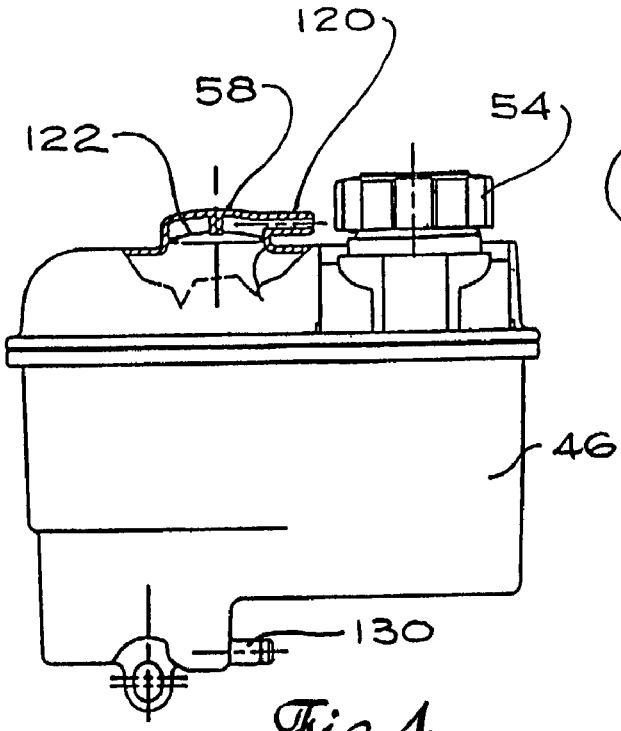

FIGS. 3 and 4 show the fuel tank 46 and fuel tank vent 58 in greater detail. The vent 58 includes a connection port 120 adapted to be coupled to the valve 66 of the fuel vent closure device 62. Any suitable conduit (not shown) can be used to provide communication between the connection port 120 and the valve 66. As best seen in FIG. 4, the vent 58 can also include a baffle 122 that substantially prevents liquid fuel in the tank 46 from splashing out of the connection port 120. The baffle 122 can be any suitable, gasoline-resistant material and is preferably in the form of a disk that has a diameter slightly smaller than the diameter of the vent sidewalls. With this construction, liquid fuel cannot splash into the connection port 120, but air and fuel vapors can pass between the edge of the baffle 122 and the vent sidewalls for venting when the vent 58 is opened. The actual placement and design of the vent 58 in the tank 46 may be different than shown to get optimum separation of liquid and vapor fuel. The vent 58 could also be located in the fuel cap 54.

Figure 5:
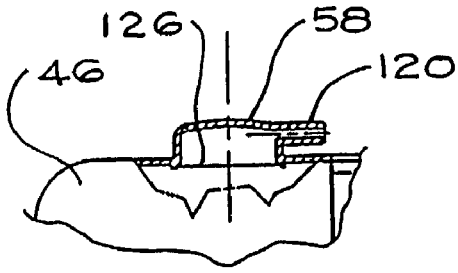
FIG. 5 is a partial view of FIG. 4 showing an alternative vent configuration.

FIG. 5 shows an alternative construction for preventing liquid fuel from splashing out of the connection port 120. The vent 58 includes a gasoline-resistant membrane 126 that is substantially pervious to air and fuel vapor, but is substantially impervious to liquid fuel. When the vent 58 is opened, air and fuel vapor can pass through the membrane 126, but liquid fuel cannot.

FIG. 4 also shows a fuel outlet port 130 located at the bottom of the tank 46. The fuel outlet port 130 is adapted to be connected to a conduit (not shown) that communicates with the valve 86 of the fuel shutoff device 82. It is important to note that the configuration of the fuel tank 46, the vent 58, and the fuel outlet port 130 is not limited to the configurations shown in the figures, but rather can be tailored to work in conjunction with a variety of devices having different types of fuel vent closure devices 62 and fuel shutoff devices 82.

Figure 6:
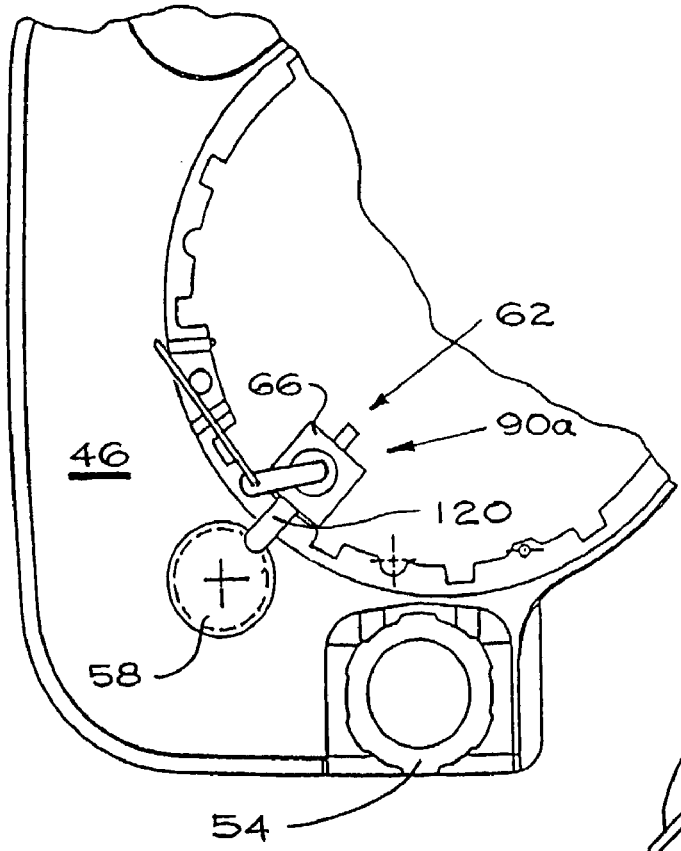
FIGS. 6 and 7 show a mounting arrangement for the fuel vent closure and fuel shutoff device.
Figure 7:
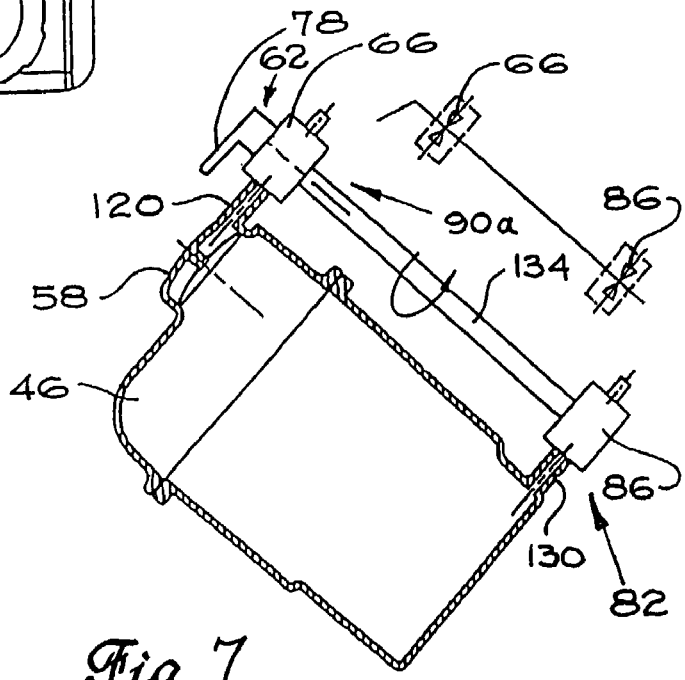

For example, FIGS. 6 and 7 illustrate an alternative embodiment wherein the connection port 120 and the fuel outlet port 130 extend substantially parallel to one another in the same plane. Instead of using conduit to connect the ports 120 and 130 to the respective valves 66 and 86, the valves 66 and 86 may be directly connected to the respective ports 120 and 130 outside of the fuel tank 46 as shown. The vent closure device 62 and the fuel shutoff device 82 may be part of a single valve assembly 90*a*, as shown, or alternatively may be two interconnected valve assemblies (not shown). The valves 66 and 86 are connected via a shaft 134 which rotates in response to actuation of the pressure cylinder 70, 96 and piston device 74, 98 to open and close the valves 66 and 86.

Figure 8:
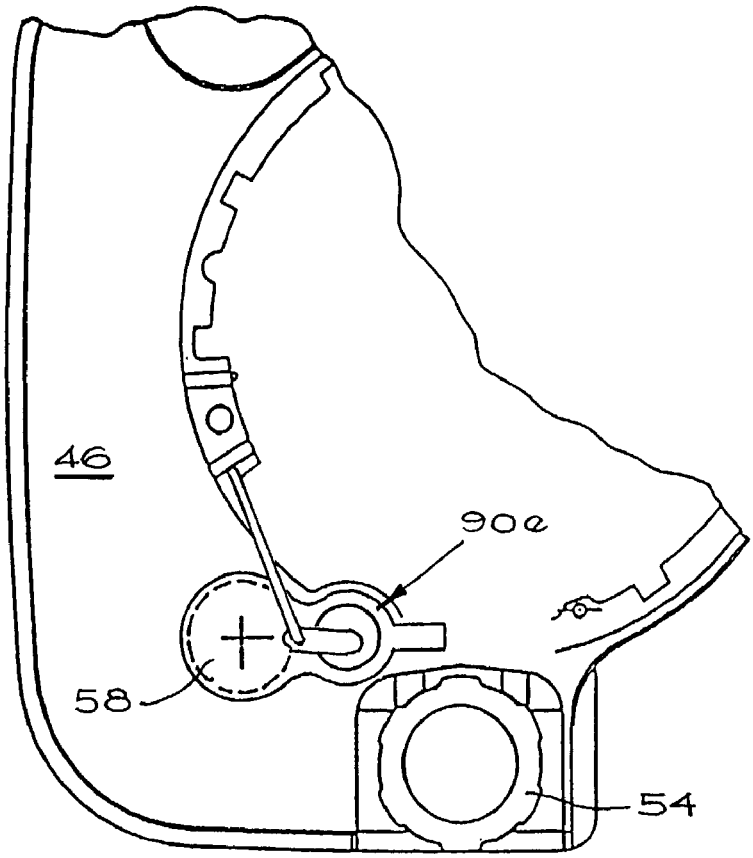
FIGS. 8 and 9 show an alternative mounting arrangement for the fuel vent closure and fuel shutoff device.
Figure 9:
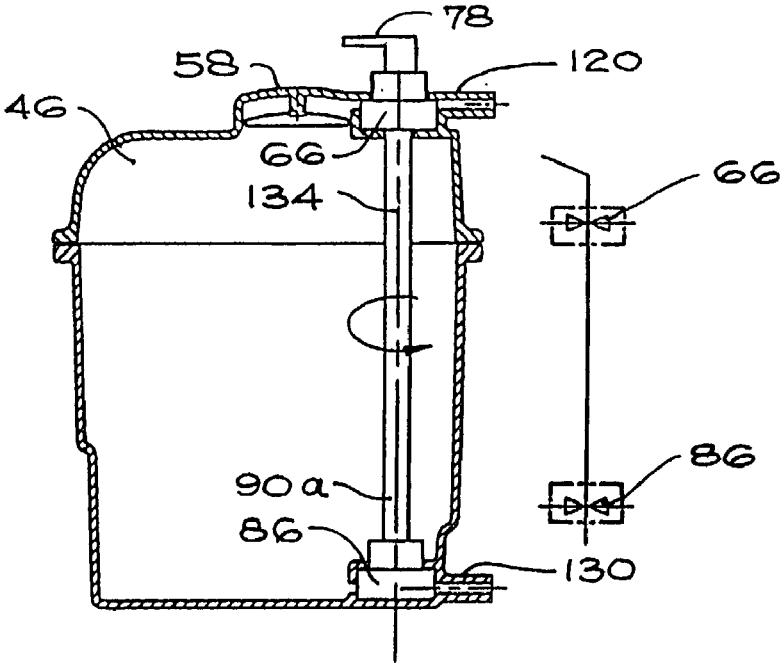

FIGS. 8 and 9 illustrate an alternative embodiment wherein the valve assembly 90*a* is located at least partially inside the fuel tank 46. By positioning the valve assembly 90*a* inside the fuel tank 46, the number of parts can be reduced. Any suitable method of securing the valve assembly 90*a* inside the fuel tank 46 can be used. With this embodiment, the valve 66 is part of the vent 58 so that vapors escaping the tank 46 pass through the valve 66 prior to exiting the connection port 120. Likewise, air drawn into the tank 46 enters the connection port 120 prior to passing through the valve 66. The valve 86 is also inside the fuel tank 46 such that fuel passes through the valve 86 prior to exiting through the fuel outlet port 130.

Figure 10:
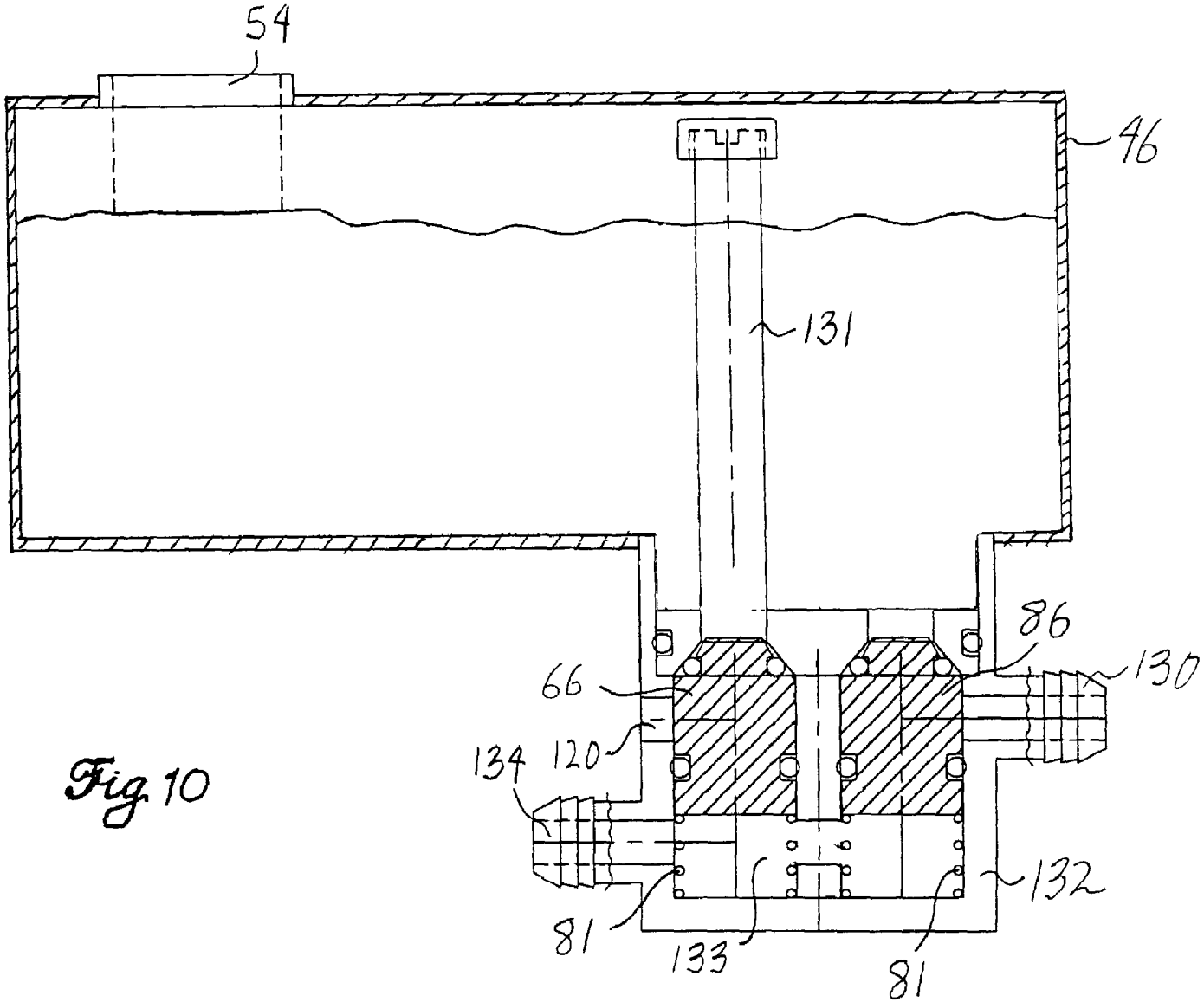
FIG. 10 shows another alternative mounting arrangement for the fuel vent closure and fuel shutoff device.

FIG. 10 illustrates an alternative embodiment wherein both the valve 66 and the valve 86 are positioned near the bottom of the fuel tank 46. In this embodiment, a fuel vent tube 131 extends upwardly within the fuel tank 46 to a position above the fuel level. The vent closure valve 66 and the fuel shutoff valve 86 are each slidably received in a valve housing 132 that defines a pressure chamber 133. The pressure chamber 133 includes a communication port 134 to which a fluid conduit (e.g. the fluid conduit72 or the fluid conduit 100) is connected. During engine operation, the vacuum provided by the intake manifold 55 and/or the auxiliary pressure supply device 92 is communicated to the pressure chamber 133, thereby urging the valves 66, 86 downwardly. Movement of the valves 66, 86 in this manner allows fuel to flow to the carburetor 50 via the fuel outlet port 130, and fuel vapors are vented from the fuel tank 46 via the connection port 120. The embodiment of FIG. 10 reduces the number of parts because the valves 66, 86 function in a similar manner as the piston devices 74, 98 of FIGS. 1 and 2, and the valve actuating member 78 can be eliminated.

Figure 11:
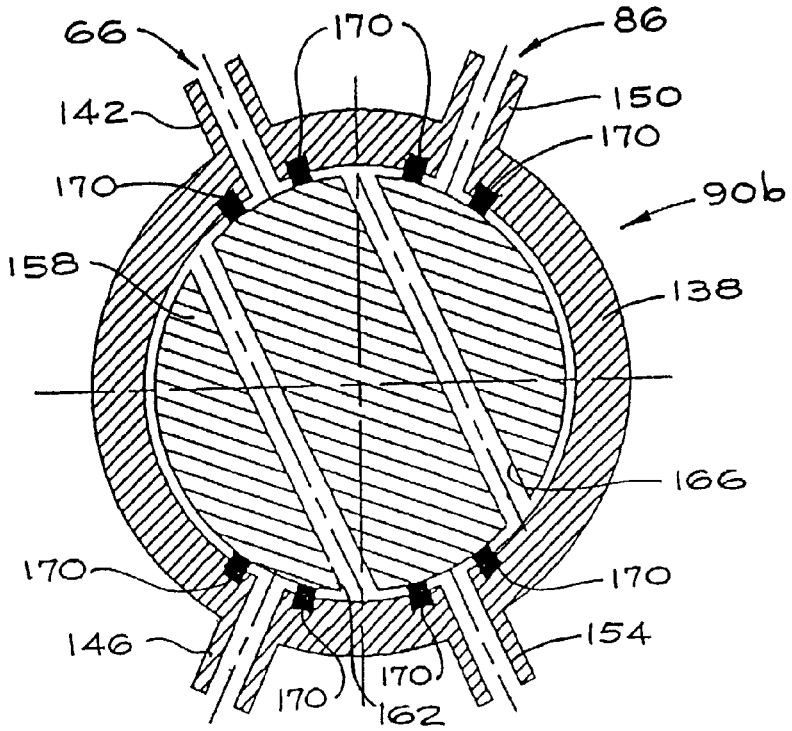
FIGS. 11 and 12 show a valve design that can be used for the fuel vent closure and fuel shutoff device.
Figure 12:
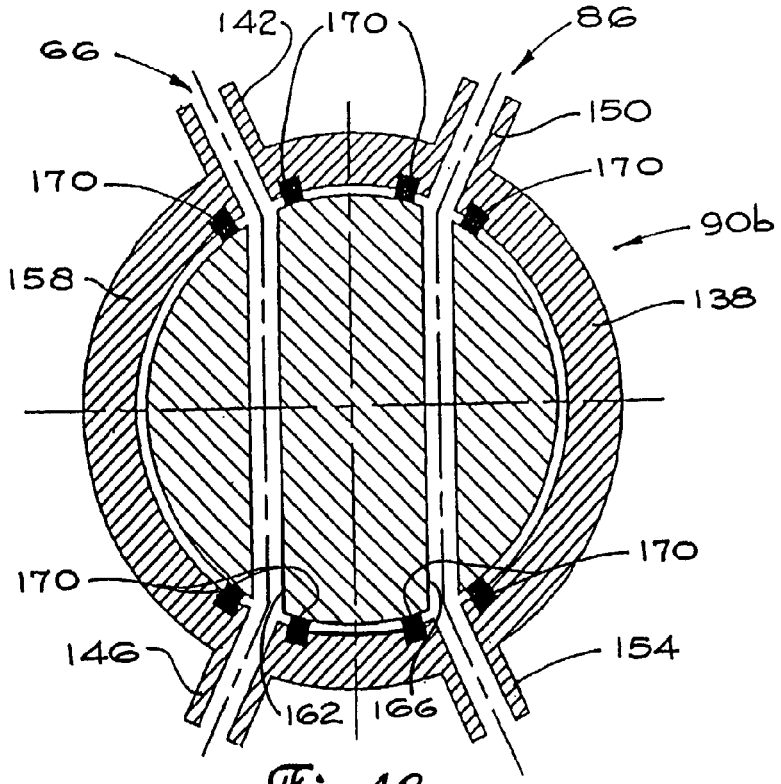

There are numerous possible designs available for the valves 66 and 86, and for the valve assembly 90. For example, FIGS. 11 and 12 illustrate one type of rotary valve assembly 90*b* that could be used. The valve assembly 90*b* includes an outer sleeve 138 having a vapor inlet 142, a vapor outlet 146, a fuel inlet 150, and a fuel outlet 154. It should be noted that the terms "vapor inlet" and "vapor outlet" are given with respect to the direction at which fuel vapor flows out of the tank 46, however, if air from the surroundings is flowing into the tank 46, the vapor outlet acts as an air inlet and the vapor inlet acts as an air outlet.

A rotatable shaft 158 is housed inside the outer sleeve 138. The shaft 158 includes two transverse holes extending therethrough. Hole 162 selectively provides fluid communication between the vapor inlet 142 and the vapor outlet 146, thereby acting as the valve 66, while hole 166 selectively provides fluid communication between the fuel inlet 150 and the fuel outlet 154, thereby acting as the valve 86. Seals 170 are positioned between the sleeve 138 and the shaft 158 to seal the gap between the sleeve 138 and the shaft 158.

As seen in FIG. 11, when the engine is not in operation, the shaft 158 is rotated such that the holes 162 and 166 are not aligned with the respective inlets 142, 150 and outlets 146, 154. In this position, no air or fuel vapor can pass through the valve 66 and no fuel can pass through the valve 86. The orientation shown in FIG. 11 is used when the engine is not operating. In FIG. 12, the shaft 158 is rotated such that the holes 162 and 166 provide fluid communication between the respective inlets 142, 150 and outlets 146, 154. The orientation shown in FIG. 12 is used during times of engine operation.

While the valve assembly 90*b* shown in FIGS. 11 and 12 is illustrated with the inlets 142, 150, the outlets 146, 154, and the holes 162, 166 all being in the same plane, it should be understood that the components of the valve 66 and the valve 86 can be in different planes as well. Such would be the case when the valve assembly 90*b* is used with the embodiments shown in FIGS. 6–9. Of course, with the valves 66 and 86 in different planes, the inlets 142, 150 and the outlets 146, 154 could be positioned anywhere along the circumferential periphery of the sleeve 138 to suit the configuration of the tank 46 and the ports 120, 130. While the valve assembly 90*b* can be used with substantially any type of pressure cylinder and piston device, due to the rotational nature of the valve assembly 90*b*, valve assembly 90*b* is particularly well suited for use with the pressure cylinder 96 and piston device 98 illustrated in FIG. 2, which have a rotational configuration.

Figure 13:
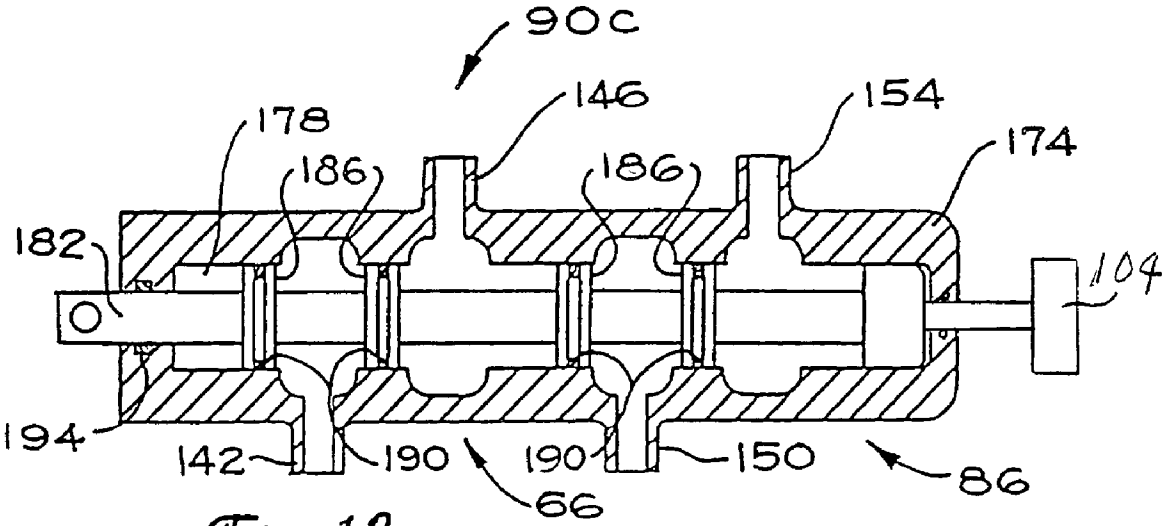
FIGS. 13 and 14 show another valve design that can be used for the fuel vent closure and fuel shutoff device.
Figure 14:
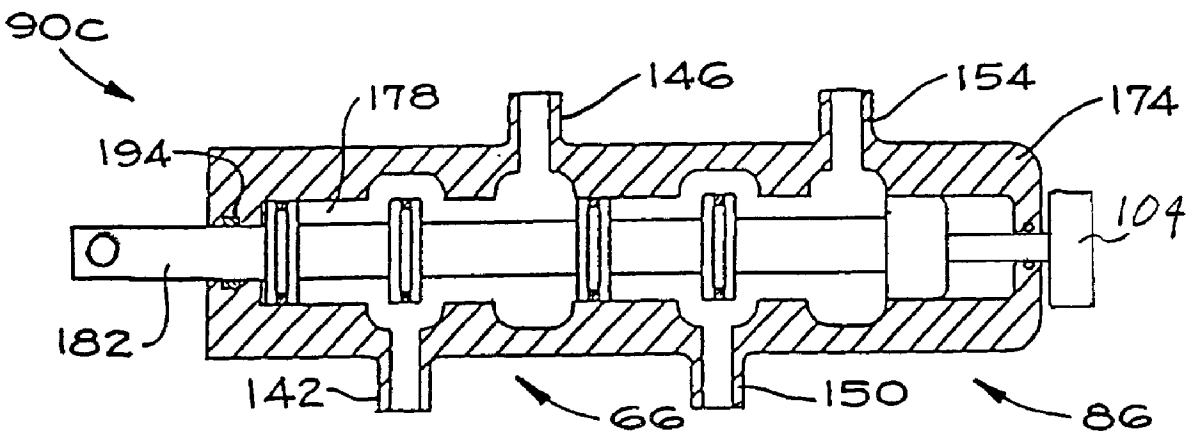

FIGS. 13 and 14 illustrate another valve assembly 90*c*. The valve assembly 90*c* is a schematic of a sliding-spool directional-flow valve and includes an outer shell 174 having inlets 142, 150 and outlets 146, 154 that communicate with an inner cavity 178. The inner cavity 178 is open at one end for slidably receiving the end of a spool 182. The spool 182 includes four sealing disks 186 mounted in spaced relation from one another. Each of the disks 186 includes a seal ring 190 that can engage portions of the cavity wall as shown to selectively seal off portions of the cavity 178 between the disks 186.

The spool 182 is slidable into and out of the cavity 178 as seen in FIGS. 13 and 14. A wiper seal 194 adjacent the open end of the cavity 178 seals the open end of the cavity 178 to substantially prevent vapors and fuel from leaking out between the spool 182 and the shell 174 during operation. FIG. 13 illustrates the closed position for the valves 66 and 86 and FIG. 14 illustrates the open position for the valves 66 and 86. The valve 90*c* is also provided with a prime button 104 that is manually actuable to move the spool 182 to the open position prior to engine start-up. While the valve assembly 90*c* can be used with substantially any type of pressure cylinder and piston device, due to the reciprocating nature of the valve assembly 90*c*, valve assembly 90*c* is particularly well suited for use with the pressure cylinder 70 and piston device 74 illustrated in FIG. 1, which have a reciprocating configuration.

Figure 15:
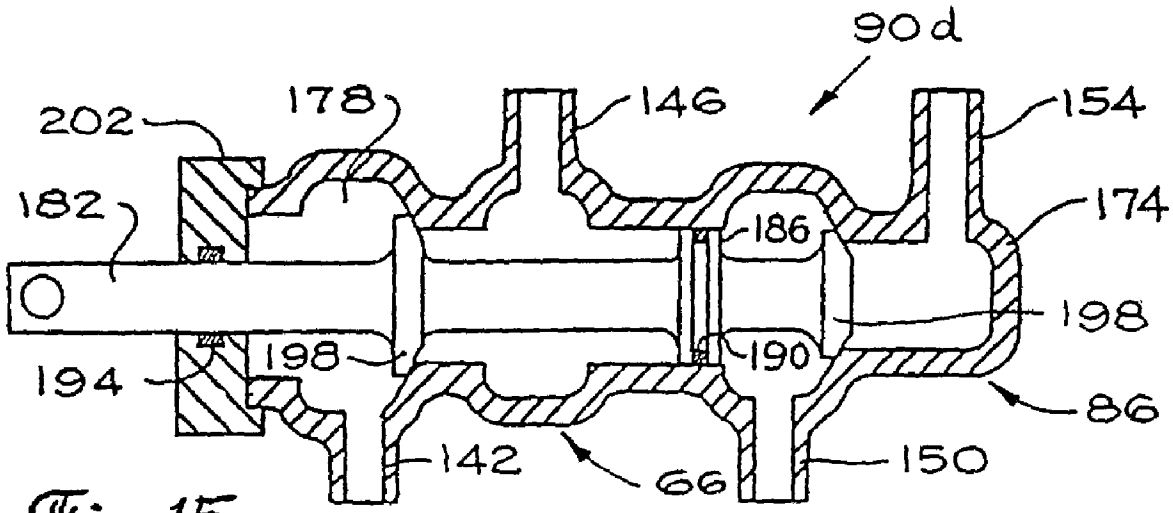
FIGS. 15 and 16 show yet another valve design that can be used for the fuel vent closure and fuel shutoff device.
Figure 16:
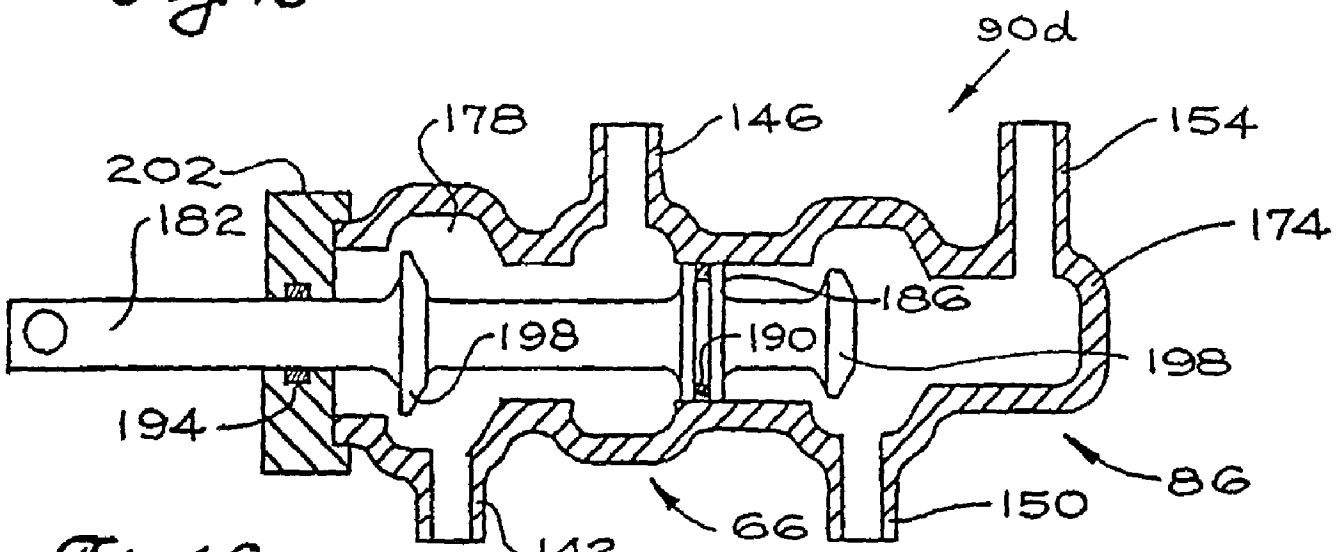

FIGS. 15 and 16 illustrate a valve assembly 90*d* that is a schematic of a poppet valve. The operation of the valve assembly 90*d* is similar to the operation of the valve assembly 90*c* and like parts have been given like reference numerals. Instead of four disks 186, the spool 182 has only one disk 186. In addition to the single disk 186, poppets 198 formed on the spool 182 engage portions of the cavity wall to selectively seal off portions of the cavity 178 between the poppets 198 and the disk 186. A separate end cap 202 closes the end of the cavity 178 and includes the wiper seal 194. FIG. 15 illustrates the closed position for the valves 66 and 86 and FIG. 16 illustrates the open position for the valves 66 and 86. Like the spool valve 90*c*, the poppet valve 90*d* is particularly well suited for use with the pressure cylinder 70 and piston device 74 illustrated in FIG. 1.

Figure 17:
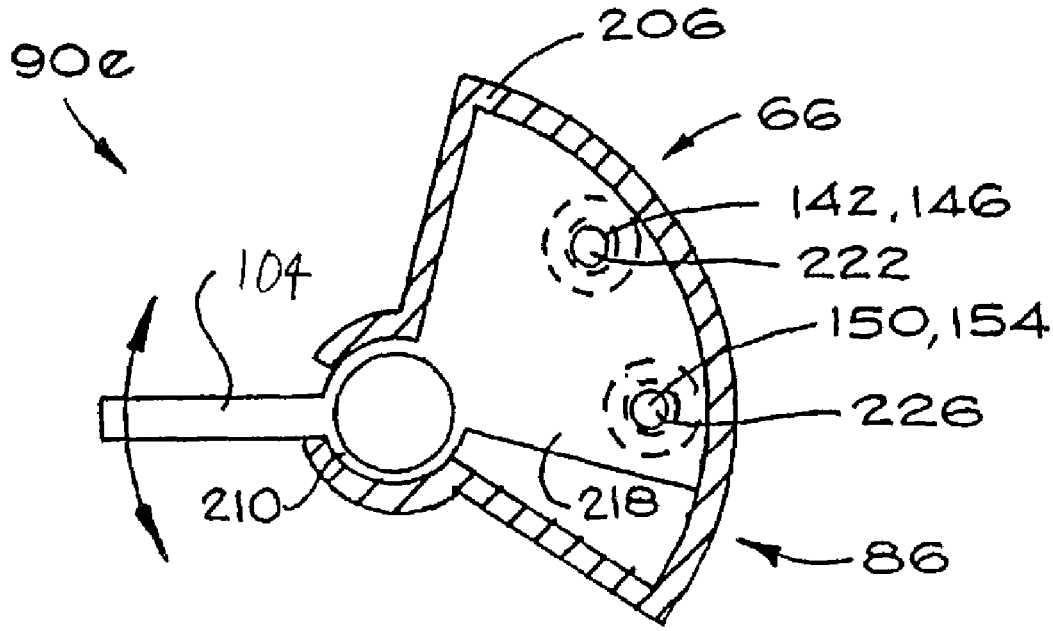
FIGS. 17 and 18 show yet another valve design that can be used for the fuel vent closure and fuel shutoff device.
Figure 18:
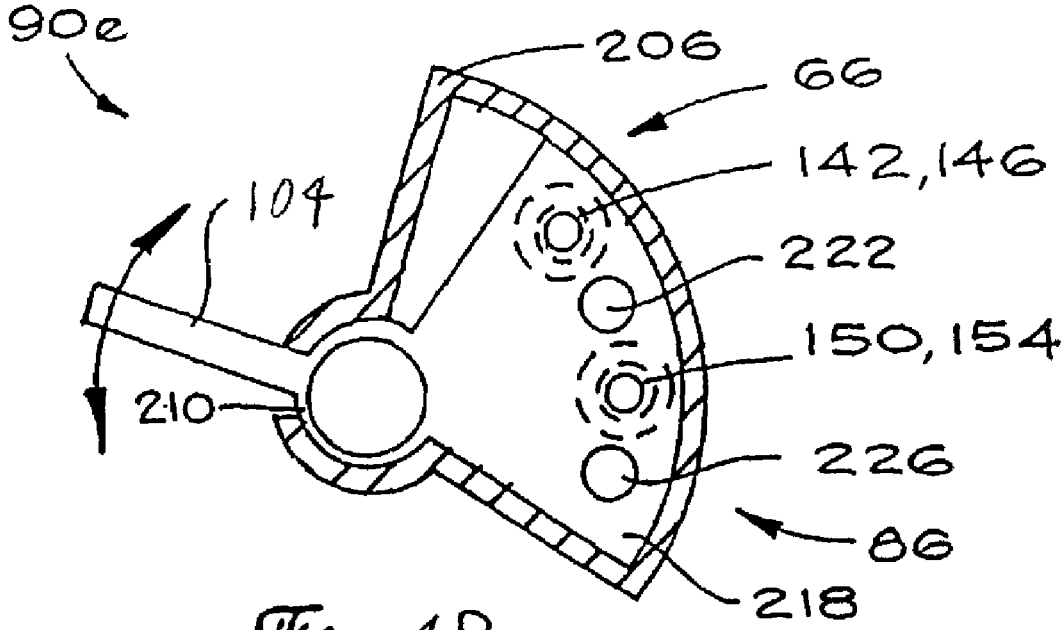

FIGS. 17 and 18 illustrate yet another valve assembly 90*e*. The valve assembly 90*e* is a schematic of an axial-sealing rotary valve and includes a housing 206 defining the inlets 142, 150 and the outlets 146, 154. A rotary member 210 is positioned within the housing 206 and rotates with respect to the housing 206 by actuation of the pressure cylinder and piston device. Due to the rotational nature of the valve assembly 90*e*, valve assembly 90*e* is particularly well suited for use with the pressure cylinder 96 and piston device 98 illustrated in FIG. 2. The valve assembly 90*e* also includes a prime button 104 in the form of a lever arm. The lever arm can be used to manually rotate the rotary member 210 to a valve-opening position prior to starting the engine. The rotary member 210 also includes a valve segment 218 having a vent aperture 222 and a fuel aperture 226 that selectively provide communication between the respective inlets 142, 150 and outlets 146, 154. Seals 230 are provided between the valve segment 218 and the housing 206.

When the valves 66 and 86 are in the open position, as shown in FIG. 17, the apertures 222 and 226 are aligned with the respective inlets 142, 150 and outlets 146, 154 to provide fluid communication therebetween. When the valves 66 and 86 are in the closed position, as shown in FIG. 18, the apertures 222 and 226 are not aligned with the respective inlets 142, 150 and outlets 146, 154 and fluid communication is blocked.

Figure 19:
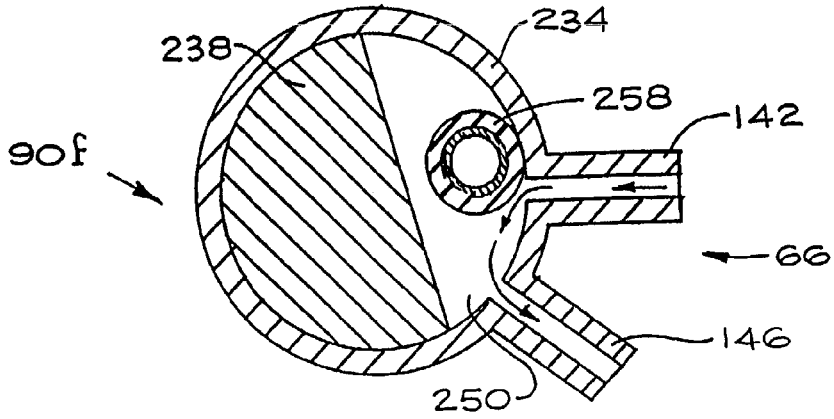
FIGS. 19–21 show yet another valve design that can be used for the fuel vent closure and fuel shutoff device.
Figure 20:
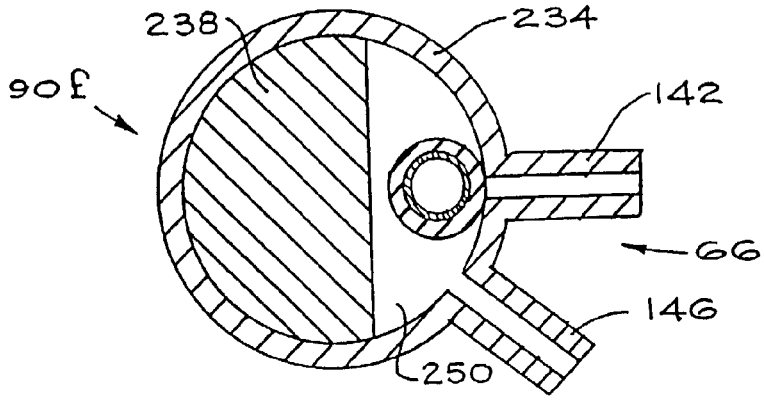
Figure 21:
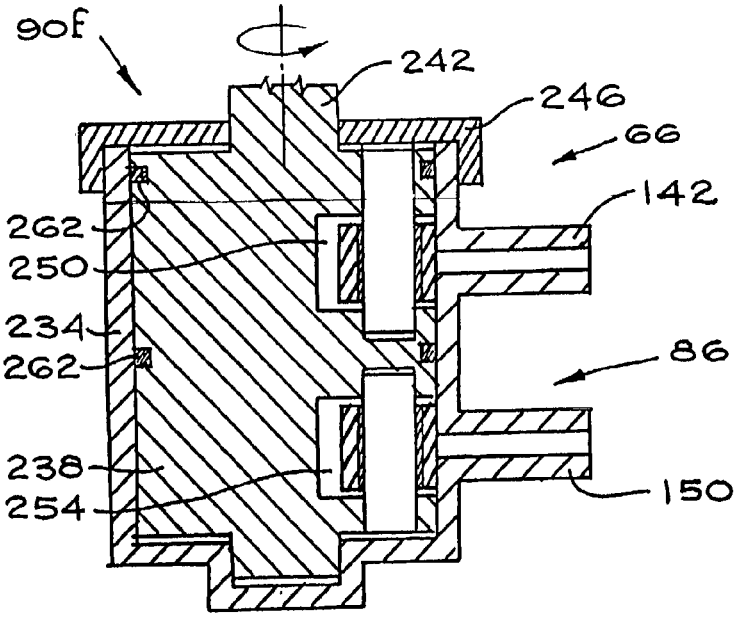

FIGS. 19–21 illustrate yet another valve assembly 90*f*. The valve assembly 90*f* is an eccentric wheel valve and includes a housing 234 having inlets 142, 150 and outlets 146, 154. A rotary member 238 is positioned inside the housing 234 and has an actuating portion 242 (see FIG. 21) extending out of the housing 234 through an end cap 246. The rotary member 238 includes upper and lower recesses 250 and 254, respectively.

A blocking member 258 is pinned in each of the recesses 250 and 254 and rolls along the inner wall of the housing 234 to selectively block and unblock the inlets 142, 150 as the rotary member 238 rotates. Of course the blocking members 250 could also be positioned to selectively block and unblock the outlets 146, 154. Seals 262 (see FIG. 21) isolate the recesses 250 and 254 from one another and from the environment outside of the housing 234. FIG. 19 illustrates the open position for the valves 66 and 86 and FIGS. 20 and 21 illustrate the closed position for the valves 66 and 86.

Figure 22:
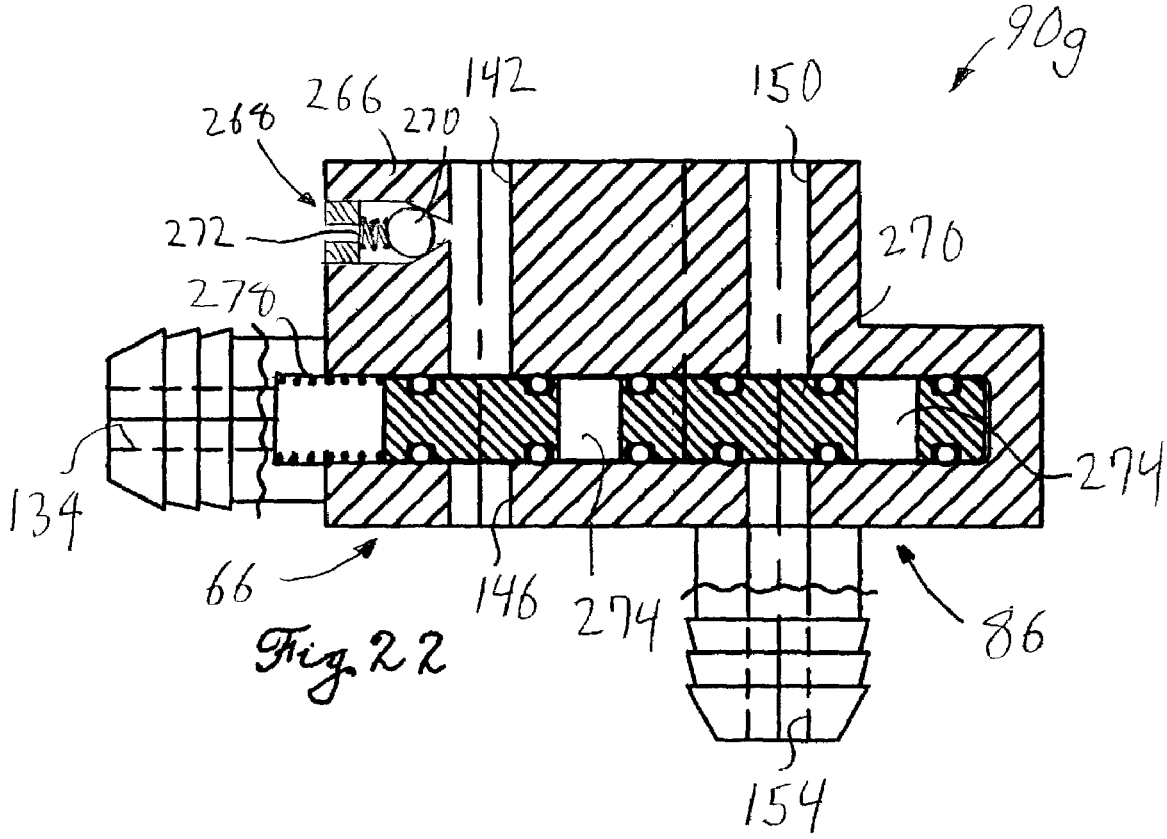
FIGS. 22 and 23 show yet another valve design that can be used for the fuel vent closure and fuel shutoff device.
Figure 23:
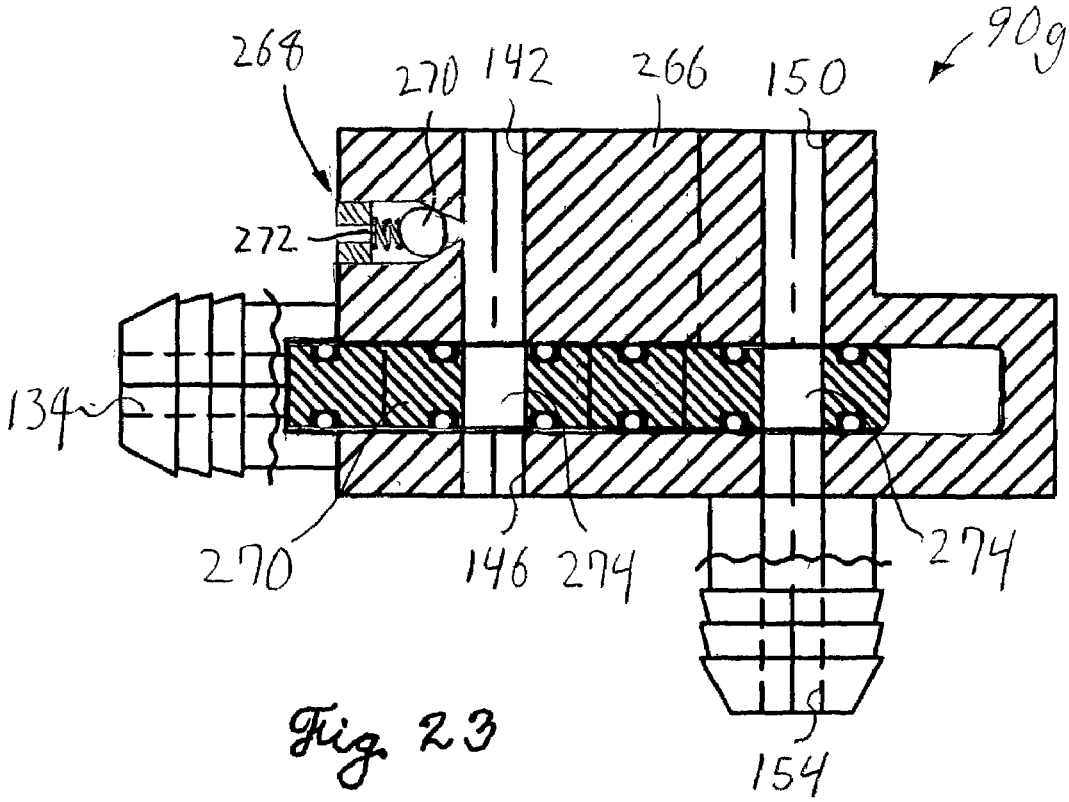

FIGS. 22 and 23 illustrate yet another valve assembly 90*g*. The valve assembly 90*g* includes a housing 266 defining inlets 142, 150 and outlets 146, 154. The inlets 142, 150 are substantially aligned with their respective outlets 146, 154. A valve member 270 is slidably received within the housing 266 and includes a pair of valve openings 274. The valve openings 274 are selectively alignable with the inlets 142, 150 and the outlets 146, 154 to open and close the vent closure valve 66 and the fuel shutoff valve 86. Like the arrangement of FIG. 10, the valve assembly 90*g* includes a communication port 134 that is directly coupled to at least one of the conduits 72, 80, or 100. The valve member 270 slides within the housing 266 in response to the pressure changes communicated to the valve 90*g* by the conduit. The valve member 270 is biased toward a closed position by a biasing spring 278. FIG. 22 shows the valve 90*g* in the closed position, whereas FIG. 23 shows the valve 90*g* in the open position.

An additional feature of the valve assembly 90*g* is the provision of a pressure relief check valve 268. The illustrated check valve 268 includes a valve ball 270 biased against a valve seat by a spring 272. The spring stiffness is selected such that in the event the pressure inside the fuel tank reaches a critical level, tank vapors will be vented from the fuel tank. Vapors released from the tank via the check valve 268 may be vented to the atmosphere, or may be vented to an evaporative emission device. While the illustrated check valve 268 is a ball type check valve, other types of check valves such as flapper valves and the like can be used as well. Also, it should be appreciated that a check valve 268 operating in a manner similar to that described above can be incorporated into substantially any of the above-described valves as desired.

Each of the valve assemblies 90 discussed above can be made from any suitable fuel-resistant materials and can be used interchangeably if the design of the device 10 so permits. It is understood that modifications to the tank 46 and the valve actuating linkages may be required depending on the type of valve assembly 90 used. Alternatively, changes to the valve assemblies 90 can be made to suit the tank and the actuating linkage configurations. It should also be noted that other valve assemblies 90 not shown or described can also be substituted. For example, while the valves 66 and 86 are shown to typically open and close at the same time, alternative arrangements can be substituted where the vent valve 66 may be positioned or timed to open prior to the fuel valve 86, or vice-versa. Furthermore, the valve assemblies 90 need not incorporate both of the valves 66 and 86 as shown. Two separate valves 66 and 86 could be used and could incorporate any of the valve types discussed above.

The different types of pressure actuated devices (e.g. the pressure cylinders 70, 96 and the piston devices 74, 98) illustrated in the figures represent only a few of the types of pressure actuated devices that can be used. Those skilled in the art would recognize other forms of pressure responsive actuators that could be substituted. Additionally, those skilled in the art would understand that by incorporating known methods of converting rotary motion to linear motion, the oscillatory output of the pressure cylinder 70 and piston device 74 of FIG. 1 and the pressure cylinder 96 and piston device 98 of FIG. 2 can be interchanged.

Various features of the invention are set forth in the following claims.

The invention claimed is:

1. A device comprising:

an internal combustion engine;

a fuel tank that provides fuel to the engine, the fuel tank having a substantially fixed volume; and a fuel vent closure device automatically operable in response to pressure changes in the engine to substantially seal the fuel tank when the engine is stopped, wherein the fuel vent closure device is actuated by a piston device that is housed in a pressure cylinder and is movable therein in response to the pressure changes.

2. The device of claim 1, wherein the fuel vent closure device is a valve.

3. The device of claim 1, wherein the piston device is reciprocable within the pressure cylinder.

4. A device comprising:

an internal combustion engine;

a fuel tank that provides fuel to the engine; and a fuel vent closure device automatically operable in response to pressure changes in the engine to substantially seal the fuel tank when the engine is stopped, wherein the fuel vent closure device is actuated by a piston device that is housed in a pressure cylinder and is movable therein in response to the pressure changes, and wherein the piston device is rotatable within the pressure cylinder.

5. The device of claim 1, wherein the piston device delimits the pressure cylinder into two fluidly isolated chambers.

6. The device of claim 1, wherein the fuel vent closure device is automatically operable in response pressure changes in the engine to vent the fuel tank.

7. The device of claim 1, wherein the fuel vent closure device is coupled to at least one of an intake manifold and an exhaust manifold of the engine, and is operable to vent the fuel tank in response to pressure changes in at least one of the intake and exhaust manifold.

8. A device comprising:

an internal combustion engine;

a fuel tank that provides fuel to the engine, the fuel tank having a substantially fixed volume; and a fuel vent closure device automatically operable in response to pressure changes in the engine to substantially seal the fuel tank when the engine is stopped, wherein the fuel vent closure device is coupled to an auxiliary pressure supply device that operates in response to rotation of the engine, and wherein the fuel vent closure device is operable to vent the fuel tank in response to pressure changes in the auxiliary pressure supply device.

9. The device of claim 1, wherein the device is a lawnmower.

10. The device of claim 1, wherein the device is a pressure washer.

11. The device of claim 1, wherein the device is a portable generator.

12. The device of claim 1, wherein the device is an automatic backup power system.

13. The device of claim 1, wherein the device is at least one of a tractor and a riding lawnmower.

14. The device of claim 1, wherein the internal combustion engine is a multi-cylinder engine.

15. The device of claim 1, wherein the internal combustion engine is a single-cylinder engine.

16. A device comprising:

an internal combustion engine;

a fuel tank that provides fuel to the engine, the fuel tank having a substantially fixed volume;

a fuel vent closure device automatically operable in response to pressure changes in the engine to substantially seal the fuel tank when the engine is stopped; and a fuel shutoff device automatically operable in response to pressure changes in the engine to substantially block a supply of fuel to the engine when the engine is stopped.

17. The device of claim 16, wherein the fuel shutoff device is a valve.

18. The device of claim 16, wherein the fuel vent closure device and the fuel shutoff device are combined into a single assembly.

19. The device of claim 16, wherein the fuel vent closure device is automatically operable in response to pressure changes in the engine to vent the fuel tank when the engine is started, and wherein the fuel shutoff device is automatically operable in response to pressure changes in the engine to unblock the supply of fuel to the engine when the engine is started.

20. The device of claim 16, wherein the fuel vent closure device and the fuel shutoff device are automatically operable in response to pressure changes in at least one of an intake manifold and an exhaust manifold of the engine.

21. The device of claim 16, wherein the fuel vent closure device and the fuel shutoff device are automatically operable in response to pressure changes in an auxiliary pressure supply device of the engine.

22. A device comprising:

an internal combustion engine;

a fuel tank that provides fuel to the engine;

a fuel shutoff valve automatically operable in response to pressure changes in the engine to substantially block the supply of fuel to the engine when the engine is stopped, and a fuel vent closure valve automatically operable in response pressure changes in the engine to substantially seal the fuel tank when the engine is stopped;

wherein the fuel shutoff valve and the fuel vent closure valve are combined into a single housing.

23. The device of claim 22, wherein at least one of the valves is a rotary valve.

24. The device of claim 23, wherein at least one of the valves is an axial-sealing rotary valve.

25. The device of claim 23, wherein at least one of the valves is an eccentric-wheel valve.

26. The device of claim 22, wherein at least one of the valves is a sliding-spool directional-flow valve.

27. The device of claim 22, wherein the at least one of the valves is a poppet valve.

28. A device comprising:

an internal combustion engine;

a fuel tank that provides fuel to the engine;

a fuel shutoff valve automatically operable in response to pressure changes in the engine to substantially block the supply of fuel to the engine when the engine is stopped;

a fuel vent closure valve automatically operable in response pressure changes in the engine to substantially seal the fuel tank when the engine is stopped, wherein the fuel shutoff valve and the fuel vent closure valve are combined into a single housing, and;

at least one valve actuating device fluidly communicating with at least one of an engine intake manifold and an engine exhaust manifold, the valve actuating device operating in response to pressure changes in at least one of the intake manifold and the exhaust manifold to automatically operate the fuel vent closure valve, and the fuel shutoff valve when the engine is stopped and started.

29. The device of claim 28, wherein valve actuating device includes a pressure cylinder and a piston device.

30. The device of claim 29, wherein the piston device reciprocates with respect to the pressure cylinder.

31. The device of claim 29, wherein the piston device rotateswith respect to the pressure cylinder.

32. The device of claim 22, wherein the device is a lawnmower.

33. The device of claim 22, wherein the device is a pressure washer.

34. The device of claim 22, wherein the device is a portable generator.

35. The device of claim 22, wherein the device is an automatic backup power system.

36. The device of claim 22, wherein the device is at least one of a tractor and a riding lawnmower.

37. The device of claim 22, wherein the internal combustion engine is a multi-cylinder engine.

38. The device of claim 22, wherein the internal combustion engine is a single-cylinder engine.

39. The device of claim 1, further comprising:

a pressure relief valve.

40. The device of claim 22, further comprising:

a pressure relief valve.

* * * * *